United States Patent [19]

Nishiyama

[11] Patent Number: 4,828,414

[45] Date of Patent: May 9, 1989

[54] OUTPUT DEVICE FOR AUTOMATICALLY CHANGING END OF LINE HOT ZONE

[75] Inventor: Masaki Nishiyama, Tokyo, Japan

[73] Assignee: Canon Kabushiki Kaisha, Tokyo, Japan

[21] Appl. No.: 171,144

[22] Filed: Mar. 21, 1988

Related U.S. Application Data

[63] Continuation of Ser. No. 52,161, May 18, 1987, abandoned, which is a continuation of Ser. No. 711,183, Mar. 13, 1985, abandoned.

[30] Foreign Application Priority Data

Mar. 19, 1984 [JP] Japan ..... 59-50855

[51] Int. Cl.[4] ..... B41J 19/68

[52] U.S. Cl. ..... 400/315; 400/342

[58] Field of Search ..... 400/1, 2, 3, 4, 5, 6, 400/7, 8, 9, 10, 11, 12, 13, 14, 15, 64, 279, 315, 342, 344, 708

[56] References Cited

U.S. PATENT DOCUMENTS 3,664,479 5/1972 Arjani et al. ..... 400/344 X 4,223,393 9/1980 Abe et al. ..... 400/279 X

FOREIGN PATENT DOCUMENTS 2087115 5/1982 United Kingdom ..... 400/3

*Primary Examiner*—Charles Pearson

*Attorney, Agent, or Firm*—Fitzpatrick, Cella, Harper & Scinto

[57] ABSTRACT

An electropic typewriter includes a changing unit for changing margin positions; a storage device for storing hot zone position information; and a deriving unit responsive to the change of the margin positions caused by the changing unit for deriving a new hot zone so as to modify the hot zone position stored in the storage device.

8 Claims, 4 Drawing Sheets

OUTPUT DEVICE FOR AUTOMATICALLY CHANGING END OF LINE HOT ZONE

This application is a continuation of application Ser. No. 052,161 filed 5/18/87, now abandoned, which was a continuation of application Ser. No. 711,183 filed 3/13/85, now abandoned.

BACKGROUND OF THE INVENTION

1, Field of the Invention

The present invention relates to a document/image editing and processing apparatus or an output device connectable thereto, and more particularly it relates to an output device such as a typewriter with which documents can be printed out in a well-proportioned and beautiful arrangement of characters.

2. Description of the Prior Art

In conventional electronic typewriters, the length of a hot zone (an alarming zone near the right margin) is maintained unchanged even if the distance between the right and left margins for setting blank portions at right and left sides of a printing paper sheet is changed. Therefore, in order to change and obtain a suitable length of the hot zone in such cases, an operator himself must reset the length of the hot zone.

In particular, with a constant length of the hot zone regardless of changing the distance between the right and left margins on the printing paper sheet, it is here assumed that the rightmost end of a printed document is intended to be aligned. In this case, since the length of the hot zone is constant, the spaces between adjacent printed characters become excessively broad or narrow in contrast with the lateral width of the printed document. Therefore, a problem arises that a well-proportioned and beautiful document cannot be obtained in spite of the elaborate rightmost alignment or right margin justification unless the length of the hot zone is manually adjusted every time the distance between the right and left margins is changed.

SUMMARY OF THE INVENTION

The present invention has been made in view of the above problem, and it is an object of the present invention to provide an output device such as an electronic typewriter in which the length of a hot zone is automatically changed, without incorporating a complicated mechanical arrangement, as the distance between right and left margin is altered, and in which a well-proportioned and beautiful arrangement of characters can be obtained by setting suitable space between adjacent words even in the case, e.g., of a rightmost alignment printing operation.

It is another object of the present invention to provide an electronic typewriter in which the length (or size) of a hot zone is made to change automatically by an operational processing of a control circuit responding to the change of the distance between right and left margins on a printing paper sheet.

It is still another object of the present invention to provide an electronic typewriter which is provided with margin setting means and hot zone setting means and can modify the length of a hot zone based upon the ratio of the newly set margin distance to the previously set margin distance.

DESCRIPTION OF THE PREFERRED EMBODIMENTS

Figure 1:
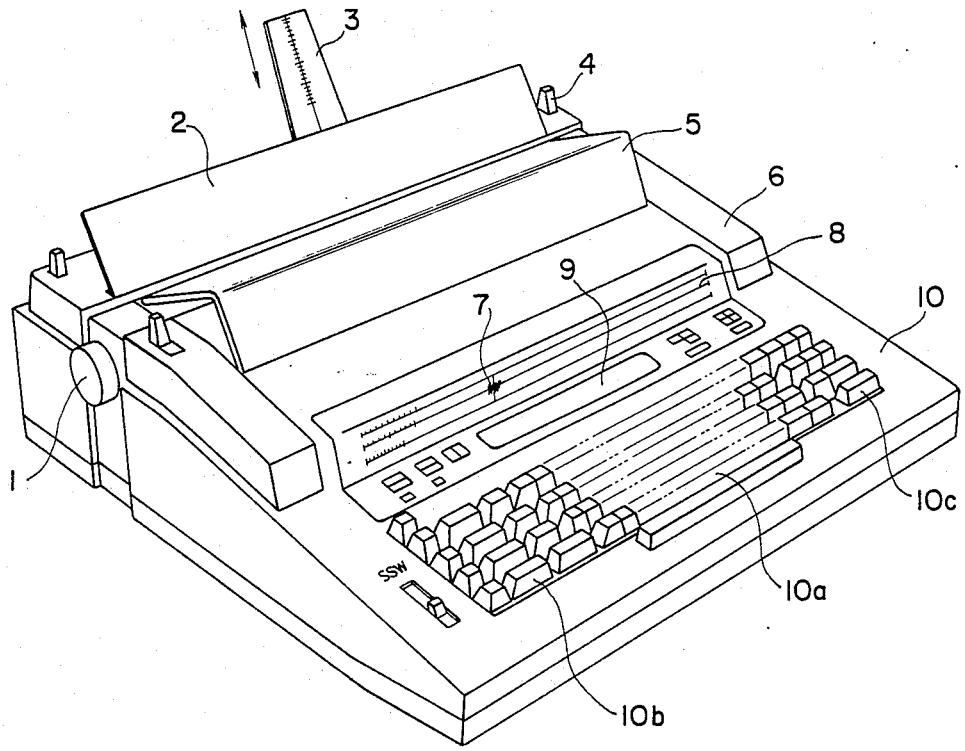
FIG. 1 is a perspective view of a typewriter to which the present invention is applicable.

FIG. 1 is a perspective view of the outer appearance of an electronic typewriter (ETW) according to an embodiment of the present invention. In the figure, a platen knob 1 is used while a printing paper sheet is loaded manually or the longitudinal position of the sheet for printing is minutely adjusted. When the knob 1 is pushed inwardly, the coupling to a drive pulse motor mounted inside the typewriter is released such that the knob 1 by itself can be turned by hand. A paper support 2 is a guide plate for a printing paper sheet, which is intended to be used for forcing the paper sheet toward an operator even if a thin paper sheet is used. A page-end indicator 3 is a scale indicative of a length to the bottom line of a paper sheet. The operator first adjusts the position of the indicator 3 along the up and down direction as shown by an arrow in such a way that a present length to the bottom line of a paper sheet can be determined by recognizing that the upper end of the sheet has passed out of the platen and reaches the preset graduation of the indicator 3. A release lever 4 is used for manually correcting the slanted setting of a paper sheet by bringing pinch rollers (not shown) mounted beneath the platen out of contact therewith. A sound-proof cover 5 is provided to arrest impact sounds caused by impact printing. Since the cover 5 is made by molding transparent acrylic resin, printed characters can be seen through the sound-proof cover 5. In order to change character style or replace a ribbon cassette an upper cover 6 is opened while turning it rearward to thereby provide necessary access for replacement of the printer wheel or ribbon cassette loaded on a carriage unit each with a new one. The electronic typewriter of this embodiment has four kinds of printing pitches in a lateral direction: 10 characters, 12 characters, 15 characters per inch and proportional spacing (hereinafter referred to as PS). In proportional spacing the printing pitch varies with the size of characters. A scale 8 has three kinds of graduations for 10 pitch, 12 pitch and 15 pitch, respectively. On the scale 8, the position of the carriage is shown by turning on a lamp in response to the pitch identified with a keyboard 10. The keyboard 10 is composed of a character key group 10*a* for inputting and printing characters and control key groups 10*b* and 10*c* disposed at both sides of the key group 10*a*. Reference numeral 9 represents a display such as a CRT or LCD on which one line to several lines can be displayed.

Figure 2:
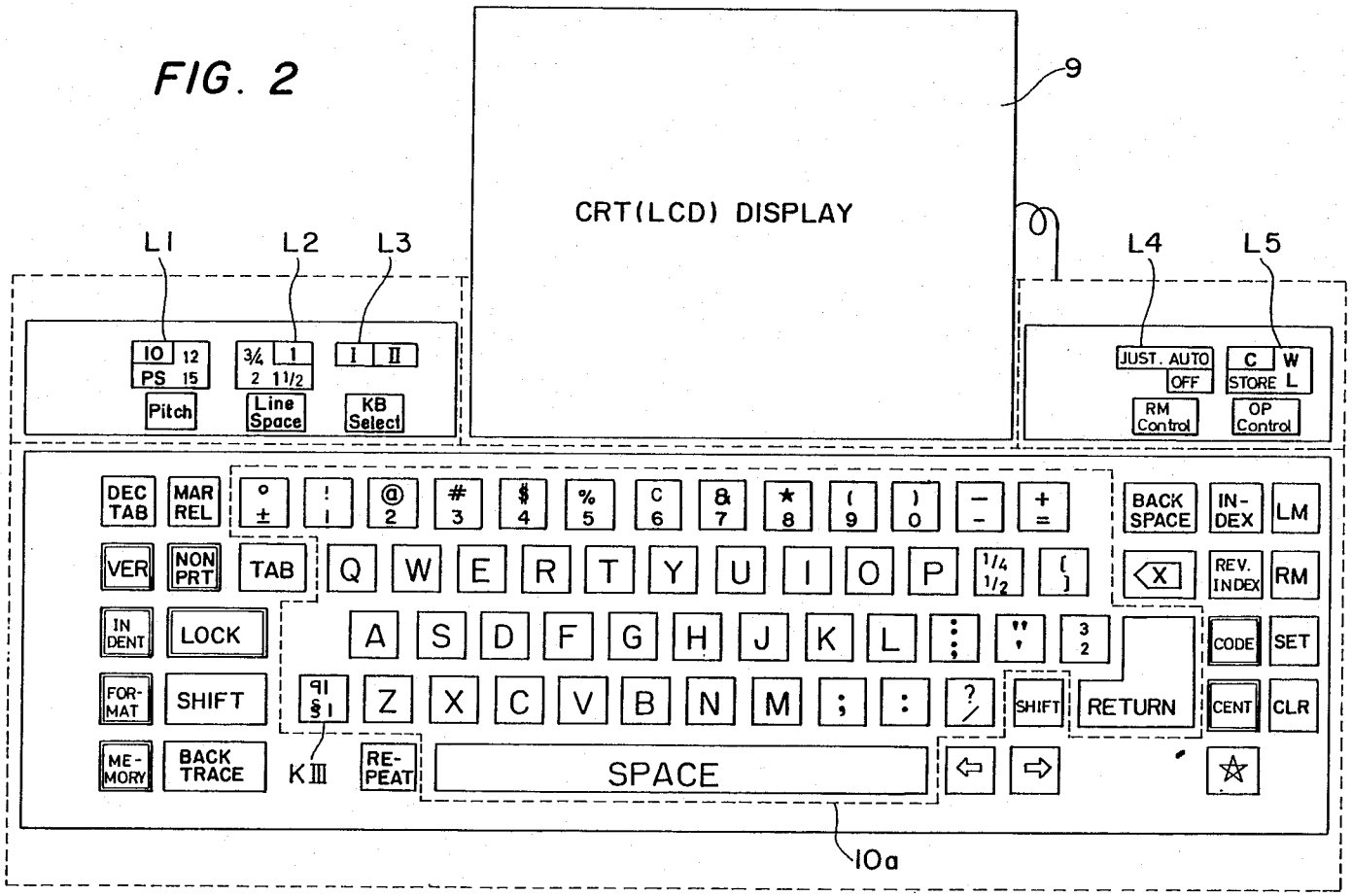
FIG. 2 is a view showing an operation section of the typewriter.

FIG. 2 is a front view of an operation panel of the electronic typewriter. In the figure, a "Pitch" key is to select as described previously the number of printing characters per inch. Every time the "Pitch" key is depressed, a display L1 made of lamps such as LEDs for indicating a pitch turns on cyclically and in the order of 10, 12, 15 and PS. The units of numbers 10, 12, and 15 are the number of characters/inch while in PS the number of characters per inch differs depending upon the size of printed characters. A "Line Space" key is for indicating the feed amount of lines a basic unit length of which is set as 1/6 inch. In this case as similarly to the above, every time the key is depressed, a display L2 made of lamps turns on cyclically. A "KB select" key provides a selective meaning for such keys as a KIII key, which has three characters represented by a single key and which cannot be selected by using a "SHIFT" key for selecting either one of two characters such as upper and lower case letters. An "R.M Control" key at the upper right is for indicating the functions of the electronic typewriter with respect to its right margin. Upon each depression of the "R.M Control" key, any one of JUST, AUTO and OFF is selected. The selection is indicated by the cyclic illumination of a display L4 made of lamps. The illumination of a JUST lamp means the selection of a right justification (right-most alignment) function, while that of an AUTO lamp means an auto-line feed. The OFF means no function as the literal meaning suggests. An "OP control" key is used for selecting a printing mode of the electronic typewriter. This key, similarly to the above keys, actuates to illuminate any one of C, W, L and STORE upon each depression so as to indicate the present printing mode. C indicates printing character by character, W indicates to print word by word, L indicates printing line by line, STORE indicates storing into an internal storing device (text buffer TB) in the line by line L mode. A "MEMORY" key is used for performing a character string (document) operation and indicating the start of operation of the storing device. A margin release "MARREL" key is for releasing the state preventing key inputs (margin stop).

Figure 3:
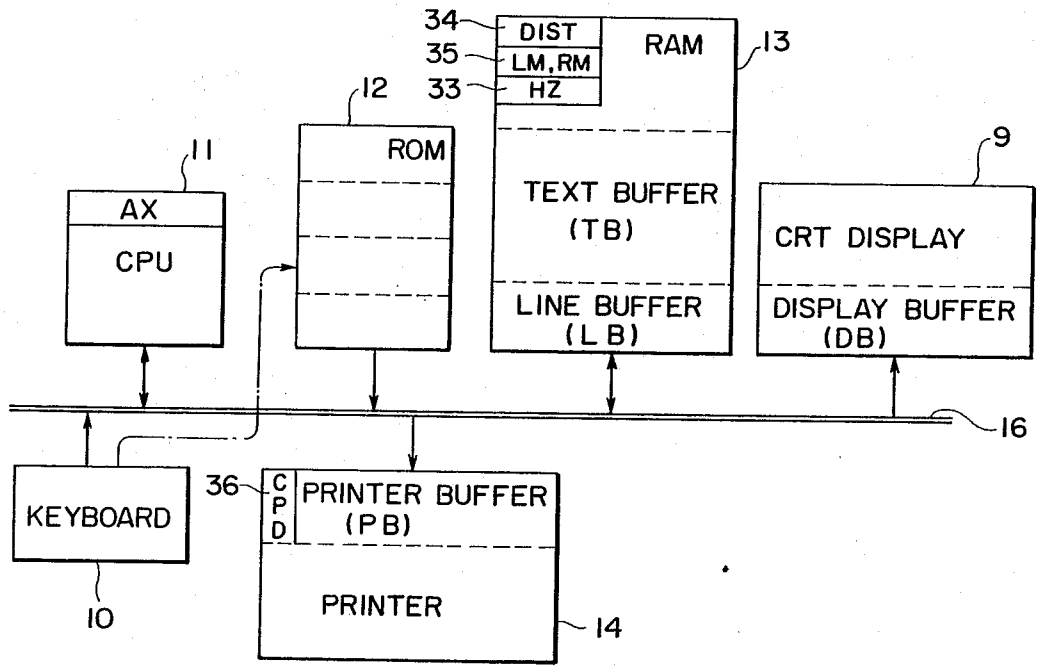
FIG. 3 is a block diagram showing the construction of the typewriter.

FIG. 3 shows in block form the construction of the electronic typewriter. In the figure, elements previously described with reference to FIG. 1 have been designated using identical reference numerals and the description thereof is omitted.

In FIG. 3, numeral 11 represents a central processing unit (CPU) for performing fundamental controls over the electronic typewriter (ETW), numeral 12 represents a ROM storing programs to be executed by the CPU 11, numeral 13 represents a RAM temporarily storing data such as document data input by keys and data required for the control of the ETW, numeral 14 represents a printer for printing out document data, and numeral 16 represents an internal common bus of the ETW connecting the CPU 11 to the above respective elements.

It is noted here that data communication between other ETWs may be made by connecting the internal common bus 16 to a serial interface which is not shown in the figure.

The construction shown in FIG. 3 will be described in more detail. The CPU 11 includes a register AX described later. Numeral 36 represents a carriage position detecting device (CPD). Numeral 35 represents a random access memory (RAM) for storing a left margin (LM) and right (RM), numeral 33 represents a random access memory (RAM) for storing a hot zone (HZ), and numeral 34 represents a random access memory (RAM) for storing a distance (DIST) between the right and left margins (RM and LM, respectively). The length of the hot zone (HZ) has been previously set and stored in the random access memory (RAM) 33.

In the electronic typewriter according to the present invention, if for example the right justification described above is to be performed, the following operation is carried out which is not common with conventional electronic typewriters. On the screen of a CRT display commonly used in the electronic typewriter of this kind, characters are sequentially input and displayed on the screen starting from the left margin (LM) end while the carriage moves. If the distance of movement of the carriage goes over the distance (DIST) between margins, i.e., the distance (RM-LM) between both margin ends, and reaches the first space position, then in order to compensate for the printed portion outside the right margin (RM) end, the distance between the right margin (RM) end and the virtual position of the carriage at that time is uniformly divided and allocated to each space between adjacent words on the printed line. Thus, the disposal of characters on the line is re-arranged and stored so as to realize a substantially proportionated right justification. As understood from the above, the size or length of the hot zone is the most important thing in the electronic typewriter according to the present invention.

Figure 4:
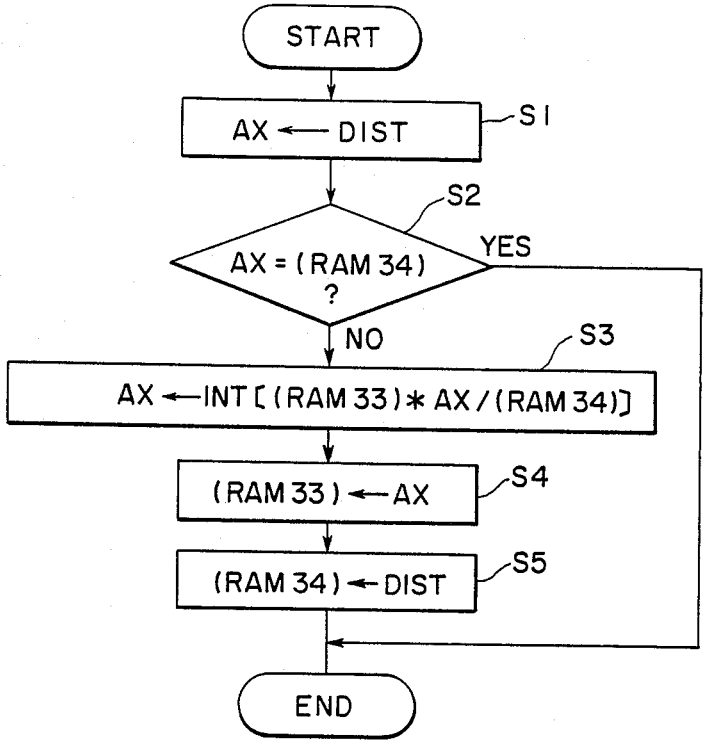
FIG. 4 is a control flow chart illustrating the sequence for varying a hot zone in accordance with the change of margin.

The processes for setting a character disposal in the above described mode of the electronic typewriter of the invention are shown in the flow chart of FIG. 4, wherein the previously set margin distance is assumed to have been stored as a preliminary margin distance in the RAM 34.

In the flow chart of FIG. 4, first at step S1 the right distance DIST between right and left margins is calculated at the CPU 11 from the values of right and left margins RM and LM in accordance with equation $DIST=RM-LM+1$ described later, and the calculated value of distance DIST is stored in the internal register AX. Next, at step S2 the coincidence is judged between the preliminary value of the above described margin distance DIST stored in the RAM 34 and the calculated value stored in the above described internal register AX. If the judgement results indicate that the preliminary and calculated values of margin distances DISTs coincide with each other, then the processes for setting a character disposal according to the present invention is terminated.

Alternatively, if the judgement results at step S2 indicate that the preliminary and calculated values of margin distances DISTs do not coincide with each other, then step S3 follows. At step S3 a hot zone modification value is calculated basing upon the deviation between both margin distances, and the calculated results of the modification value are stored in the register AX in the CPU 11. The calculation of a hot zone modification value is effected by the ratio of the margin distances:

$$INT[(RAM\ 33)*AX/(RAM\ 34)]$$

wherein INT [] represents the integer portion of the calculated results within the braces. In the equation "*" represents multiplicaiton and symbol "/" represents division. In detail, the results of division of the calculated distance value in the register AX by the preliminary margin distance value in the RAM 34 are multiplied by the preliminary value of the hot zone length stored in the RAM 33 to obtain the modification value.

Further at step S4, the foregoing hot zone modification value in the register AX is again stored in the RAM 33. In addition, at step S5 the calculated margin distance value as above described is again stored in the RAM 34 to complete the processings for setting a character disposal according to the present invention.

The following is a concrete explanation, using particular numerical values, of the above described processings for setting a character disposal according to the present invention.

Here, the left margin LM=1, right margin RM=80, and hot zone HZ=5 have previously been set. These settings are effected, for example, by inputting "5" with a numerical key to set the hot zone of 5. First, a margin distance for the LM=1 and RM=80 is calculated bearing in mind that one character can also be printed out on the left margin (LM) end, thus the addition of 1 to the subtraction results yields:

$$DIST=RM-LM+1=80$$

The preliminary margin distance value 80 is assumed to have been stored in the RAM 34 and the hot zone HZ=5 is assumed to have been stored in the RAM 33.

In this condition, if the right margin is altered to RM=40, then a calculated margin distance value becomes:

$$DIST=RM-LM+1=40-1+1=40$$

The calculated margin distance value 40 is stored in the internal register AX at step S1 shown in the flow chart. At step S2 the judgment results show that the preliminary margin distance value 80 does not coincide with the calculated margin distance value 40. Therefore, at step S3 a hot zone HZ modification value is calculated to obtain a new value INT [5×40 /80]→HZ=2 which is again stored in the RAM 33 at step S4. At step S5 the calculated margin distance DIST=40 is again stored in the RAM 34.

Consequently, as the margin distance DIST=80 for the LM=1 and RM=80 is reduced by half to the margin distance of 40 for the RM=40, the hot zone HZ value of 5 is altered to the modification value which is almost a half of the former hot zone value. Therefore, substantially and relatively the same spaces between words can be obtained even if the margin distances are changed during printing.

Figure 5:
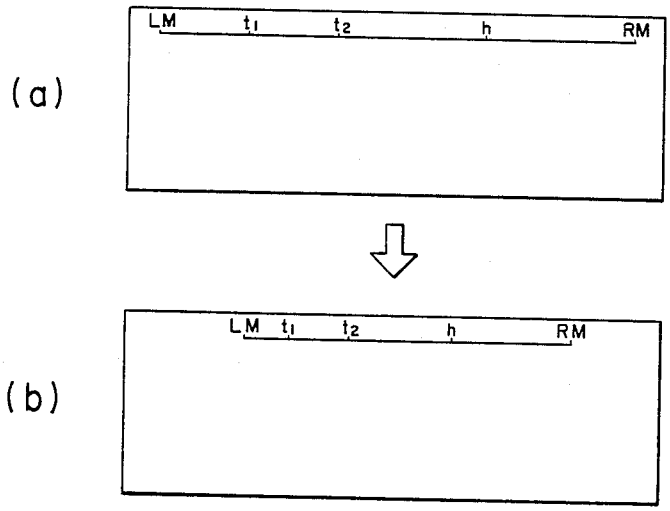
FIG. 5 shows explanatory views where the change of margin and corresponding hot zone are displayed.

In the typewriter of the above embodiment, format information on such margins and hot zone are displayed on a screen of the display. FIG. 5 shows different states of such format information displayed. Format information are represented by LM for a left margin, RM for a right margin, t for a tab, and h for a range of a hot zone, wherein LM=1, t1=3, t2=6, H=12(hot zone 5) and RM=16. Data representative of a margin distance stored as a preset or preliminary value at step S2 in FIG. 4 in the RAM 34, is 16−1+1=16. Assuming that LM=4 and RM=14, then at step S1, DIST=16−4+1=13=AX. As a result, at step S3, INT [5*13/16]=4. Thus, the display changes its state from FIG. 5 (*a*) to FIG. 5 (*b*) which obviously shows the change of the hot zone in response to the change of the margin.

As seen from the foregoing description, in the electronic typewriter according to the present invention, since the hot zone length is changed in accordance with the change of margins at right and left sides of a printing paper sheet, it is remarkably advantageous in that a well-proportioned and beautiful character disposal can be enjoyed even in a right justification operation.

Although a particlular equation has been used in the above description for calculating a modified hot zone length, it is not intended to be limited thereto and various modifications may be used to obtain other suitable settings.

I claim:

1. An output device for outputting a document and image editing and processing apparatus, for outputting information in accordance with a change of at least one margin position, said device comprising:

margin setting means for setting a left margin position and a right margin position;

distance calculating means for calculating a distance between the left and right margin positions set by said margin setting means;

distance memory means for storing a distance calculated by said distance calculating means;

hot zone setting means for setting a length of a hot zone;

hot zone memory means for storing a length of a hot zone;

comparing means for comparing, when one of a left margin position, a right margin position, or a left margin position and a right margin position are newly and manually set by said margin setting means, a distance newly calculated by said distance calculating means with the distance stored in said distance memory means, to determine whether or not the distance newly calculated by the distance calculating means is equal to the distance stored in said distance memory means; and output control means, responsive to said comparing means, for automatically outputting a signal indicating the hot zone length stored in said hot zone memory means, without newly calculating a hot zone length, when said comparing means determines that the distance newly calculated by said distance calculating means is equal to the distance stored in said distance memory means, and for calculating a new length for the hot zone and outputting a signal indicating the newly calculated hot zone length when the distance newly calculated by said distance calculating means is not equal to the distance stored in said distance memory means, wherein said output control means calculates the new hot zone length on the basis of the following equation: (new hot zone length) =(hot zone length stored in said hot zone memory means) multiplied by (newly calculated margin distance) divided by (stored margin distance).

2. An output device according to claim 1, further comprising display means for displaying the left and right margin positions set by said margin setting means and, in response to the signal output by said output control means, for displaying a hot zone corresponding to one of the hot zone length set by said hot zone setting means and the hot zone length calculated by said output control means.

3. An output device according to claim 2, wherein said display means comprises a cathode ray tube (CRT) display, the left and right margin positions are indicated by "LM" and "RM" respectively, and a start point of said hot zone is indicated by "h".

4. An output device according to claim 1, wherein the stored hot zone length is replaced in said hot zone memory means by the hot zone length newly calculated by said output control means.

5. An output device for a document and image editing and processing apparatus, for outputting information in accordance with a change of at least one margin position, said device comprising:

margin setting means for setting a left margin position and a right margin position;

reference distance memory means for storing a predetermined reference margin distance;

reference hot zone length memory means for storing a predetermined reference hot zone length corresponding to the predetermined reference margin distance;

comparing means for calculating a distance between the left and right margin positions set by said margin setting means, and for comparing the calculated distance with the predetermined reference margin distance stored in said reference distance memory means, to determine whether or not the calculated distance between the left and right margin positions set by said margin setting means is equal to the predetermined reference margin distances; and output control means, responsive to said comparing means, for outputting a signal indicating the predetermined reference hot zone length stored in said reference hot zone length memory means when said comparing means determines that the calculated distance is equal to the predetermined reference margin distance, and for calculating a new hot zone length and outputting a signal indicating the newly calculated hot zone length when said comparing means determines that the calculated distance is not equal to the predetermined reference margin distance, wherein said output control means calculates the new hot zone length on the basis of the following equation: (new hot zone length) =(predetermined reference hot zone length) multiplied by (calculated distance) divided by (predetermined reference margin distance).

6. An output device according to claim 5, further comprising display means for displaying the left and right margin positions set by said margin setting means and, responsive to the signal output by said output control means, for displaying a hot zone corresponding to one of the predetermined hot zone length and the hot zone length calculated by said output control means.

7. An output device according to claim 6, wherein said display means comprises a cathode ray tube (CRT) display, the left and right margin positions are indicated by "LM" and "RM", respectively, and a start point of the hot zone is indicated by "h".

8. An output device according to claim 5, further comprising input means for inputting a predetermined reference margin distance and a predetermined reference hot zone length.

* * * * *